United States Patent [19]

Marques

[11] Patent Number: 4,574,918

[45] Date of Patent: Mar. 11, 1986

[54] LADDER LOCKING MECHANISM

[75] Inventor: Salvador A. Marques, Barcelona, Spain

[73] Assignee: Andral Corporation, Williamsville, N.Y.

[21] Appl. No.: 600,804

[22] Filed: Apr. 16, 1984

Related U.S. Application Data

[63] Continuation-in-part of Ser. No. 341,830, Jan. 22, 1982, Ser. No. 492,487, May 6, 1983, and Ser. No. 537,276, Sep. 29, 1983.

[51] Int. Cl.[4] ..... E06C 1/383

[52] U.S. Cl. ..... 182/164; 182/211

[58] Field of Search ..... 182/164, 163, 204, 23, 182/211; 108/146

[56] References Cited

U.S. PATENT DOCUMENTS

| | | | |
|---|---|---|---|
| 409,711 | 8/1889 | Sickles | 182/204 |
| 974,018 | 10/1910 | Binckley | 108/146 |
| 2,499,091 | 2/1950 | Brubaker | 182/200 |
| 2,976,070 | 3/1961 | Gollbach | 182/94 |
| 3,948,352 | 4/1976 | Larson | 182/204 |
| 4,423,797 | 1/1984 | Batten | 182/204 |
| 4,448,283 | 5/1984 | Marques | 182/164 |
| 4,457,391 | 7/1984 | Marques | 182/164 |

FOREIGN PATENT DOCUMENTS

| | | | |
|---|---|---|---|
| 2384100 | 11/1978 | France | 182/23 |
| 46626 | 6/1917 | Sweden | 182/163 |
| 433724 | 8/1935 | United Kingdom | 182/164 |

*Primary Examiner*—Reinaldo P. Machado
*Attorney, Agent, or Firm*—James J. Ralabate

[57] ABSTRACT

A portable folding ladder comprising a plurality of U-shaped modules having a rung and two vertical portions, the modules movable connected to each other, and when opened becoming progressible narrower as they approach the top of the ladder, when folded the narrower modules fitting inside of the next wider modules and locking means to lock the modules in a rigid manner which when the ladder is extended and open.

7 Claims, 12 Drawing Figures

LADDER LOCKING MECHANISM

This application is a continuation in part of U.S. Ser. No. 341,830 filed in the U.S. Patent and Trademark Office Jan. 22, 1982, of U.S. Ser. No. 492,487 filed in the U.S. Pat. and Trademark Office May 6, 1983 and of U.S. Ser. No. 537,276 filed in the U.S. Patent and Trademark Office Sept. 29, 1983.

This invention relates to ladders and, more particularly, to locking means for fold-up ladders.

BACKGROUND OF THE INVENTION

In U.S. Ser. No. 341,830 a fold-up portable ladder is disclosed which comprises a plurality of U-shaped sections, that form both the rungs and side rails of a ladder when assembled. Each section is attached and hinged at its lower portion to the next adjacent section. Positioned below each of said hinges are latches adapted to fit into and mate with an aperture located in the vertical wall of the said next adjacent section, the lowest of said u-shaped sections beieng the widest and the top uppermost of said u-shaped sections being the narrowest and each of said sections in between being progressively narrower as they approach the top section. The latches are spring loaded so that when aligned with and mated into said aperture they will remain in place and securely hold each rung in position. To disengage each latch, there is positioned in each horizontal rung portion a spring and an external latch or spring release. When the pair of latch or spring releases are pinched together, the latch is forced away from said apertures and releases each U-shaped section from the next adjacent section. The vertical arms of each U-shaped section thus are connected to and aligned with the next section by the use of latches located in the horizontal base of each U-shaped section. The latches in the horizontal base fit into the orifice or aperture in each vertical section adjacent to it. Each aperture has tapered grooves or slide portions that allow the latches to slip into the aperture easily when setting the ladder up for use. Also, the tips of each latch portion is tapered to conform to the configuration of each orifice or aperture slide portion that facilitates the movement of the latch into the aperture. The spring releases need not be manipulated when setting up the ladder, only when the ladder is to be folded up after use.

In U.S. Ser. No. 492,487 a portable fold-up ladder is disclosed having spring rung releases that comprise two means that are pinched together (FIGS. 1B, 2, 3A, and 3B). Also, in the same application in FIG. 3C a single means spring release is disclosed wherein ring 24 is turned or pulled to release the modules from each other. In this U.S. Ser. No. 492,487 each section or module of the ladder is attached and hinged at its lower portion to the next adjacent wider section, the wider modules or sections are movably positioned below each of the narrower modules. Below said hinges are locking latches to fit into and mate with an aperture located in the vertical wall of the said next adjacent section, the lowest of said U-shaped modules or sections being the widest and the top uppermost of said U-shaped sections being the narrowest. Each of said sections in between the top and lowest sections are progressively narrower as they approach the said top section. The latches are spring loaded so that when aligned with and mated into the aperture they will remain in place and securely hold each module in position. To disengage each module, there is positioned in each horizontal rung portion a spring and an external latch release. When the pair of latch releases of FIGS. 3A and 3B are pinched together, the latches are forced away from said apertures and releases each U-shaped section from the next adjacent section. Alternatively, when the release 24 (of FIG. 3C) is turned or pulled the latches are forced away from said apertures and releases each U-shaped section from the next adjacent section. The vertical or upright arms of each U-shaped section thus are connected to and aligned with the next section by the use of latches located in the horizontal base of each U-shaped section. The latches in the horizontal base are aligned with and fit into the orifice or aperture in each vertical section adjacent to it. Also, the tips of each latch portion are tapered at their ends for easy sliding into each orifice or aperture. The latch releases need not be manipulated when setting up the ladder, only when the ladder is to be folded up after use.

In Ser. No. 537,276 several latch release means are disclosed, a central rung release means as shown in FIGS. 1A and 1B, an outer module side release means shown in FIGS. 2A, 2B and 3, an inner module side release means shown in FIGS. 2A and 4, and a terminal rung release means as shown in FIG. 5. Each section or module is attached and hinged at its lower portion to the next adjacent wider section, the wider modules or sections are movably positioned below each of the narrower modules. Below or above said hinges are locking latches or slide bolts located in either the vertical side rails or any lower portion of the module adapted to fit into and mate with an aperture located in the upper portion or vertical rail of the said next wider adjacent section, the lowest of said U-shaped modules or sections being the widest and the top uppermost of said U-shaped sections being the narrowest. Each of said sections in-between the top and lowest sections are progressively narrower as they approach the said top section. The latches or bolts are spring loaded so that when aligned with and mated into the aperture they will remain in place and securely hold each module in position. To disengage each module, there is positioned in each module lower portion (except the lowest module) a spring and an external latch or lock release. When the latch releases are turned or pulled or moved, the latch or bolt is forced away from said apertures and releases each U-shaped modular section from the next adjacent section. The vertical or upright arms of each U-shaped section thus are connected to and aligned with the next section by the use of latches and apertures in the lower portion of the narrower module and the upper portion of the wider module of each U-shaped section. The latches in the horizontal base are aligned with and fit into the orifice or aperture in each module section adjacent to it. Also, the tops of each latch portion are tapered at their ends for each sliding into each orifice or aperture. It is preferred the latches be spring loaded, however, a conventional slide bolt lock can be used. In using spring loaded locks, the latch releases need not be manipulated when setting up the ladder, only when the ladder is to be folded up after use. This is achieved by forming the ladder from metal that is at least partially eliptical, curved, or rounded in cross-section and from bolts or latches having rounded or tapered ends. In the ladder disclosed in Ser. No. 537,276 several modifications of locking mechanisms are disclosed. These are intended to be included in the present application.

SUMMARY OF THE INVENTION

It is, therefore, an object of this invention to provide module locking means of the type described in the parent applications above noted.

It is another object of this invention to provide a module locking means that is easy to use and provides a secure locking mechanism.

Another object of this invention is to provide a locking mechanism that is integral with either the rungs or side rails of a foldable ladder.

Still another object of this invention is to provide a module locking mechanism that is relatively simple in structure and yet effective in use.

Yet another object of this invention is to provide a module locking mechanism that is comparatively easy to use in foldable ladders.

The foregoing objects and others are accomplished in accordance with this invention by providing novel module locking mechanisms comprising an external lock release means, at least one latch, a spring attached to said latch and a structure containing a latch mating aperture. The external lock release means may comprise a single turn object such as a ring, solid cylindrical object, other solid turn keys or objects, or any of the above as objects to be pulled or pushed rather than turned. This disclosure will define the lock release means as being turned, however, it is to be understood that any movement of the lock release (other than turning) is intended to be included.

In a second configuration such as is disclosed in parent applications Ser. No. 341,830 and Ser. No. 492,487 the lock release means comprises two protruding elements that can be pinched together to release the latches from the holding apertures.

Once these locking mechanisms or structures have been disengaged or released, the ladder can then be folded one module within the other.

The latches of this invention usually comprise a bullet-shaped structure having a rounded or tapered end portion for easy sliding into the mating aperture. Each latch resembles a cylinder having at least one end portion tapered rather than flat as in conventional cylinders.

In one configuration two latches are tied together or otherwise connected by a nylon cord or wire or any other suitable connector. This connector will be referred to throughout the disclosure and claims as "cord", however, it is understood that this term includes wire, string, rope, chains, or any other suitable connecting means. A turn key or external lock release means is positioned approximately midway between the latches. When the lock release means is turned it will cause the connecting cord to pull the latches inwardly and disengage them from the apertures in the side rails or other portions of the modules.

In another configuration two latches are separately connected by cord or other means to an external lock release means (two release means) and when these extend release means are pinched or pressed together, the latches will be released from the aligned or mated aperture. This will disengage each module and the ladder can then be folded for storage or carrying. This embodiment is shown in FIGS. 3 and 4 of U.S. Ser. No. 341,830 and a modification is shown in FIG. 2 of the present disclosure.

Still another configuration comprises a latch or latches comprising telescoping cylinders spring loaded so that the latch can be pulled or turned out from the aperture and then will return to its original spring loaded position.

While these above configurations are preferred, other locking means such as sliding bolts or latches, etc. may be used if desired.

DESCRIPTION OF THE DRAWING AND DESCRIPTION OF THE PREFERRED EMBODIMENTS

The preferred embodiments of this invention are illustrated in the accompanying drawings and description.

Figure 1A:
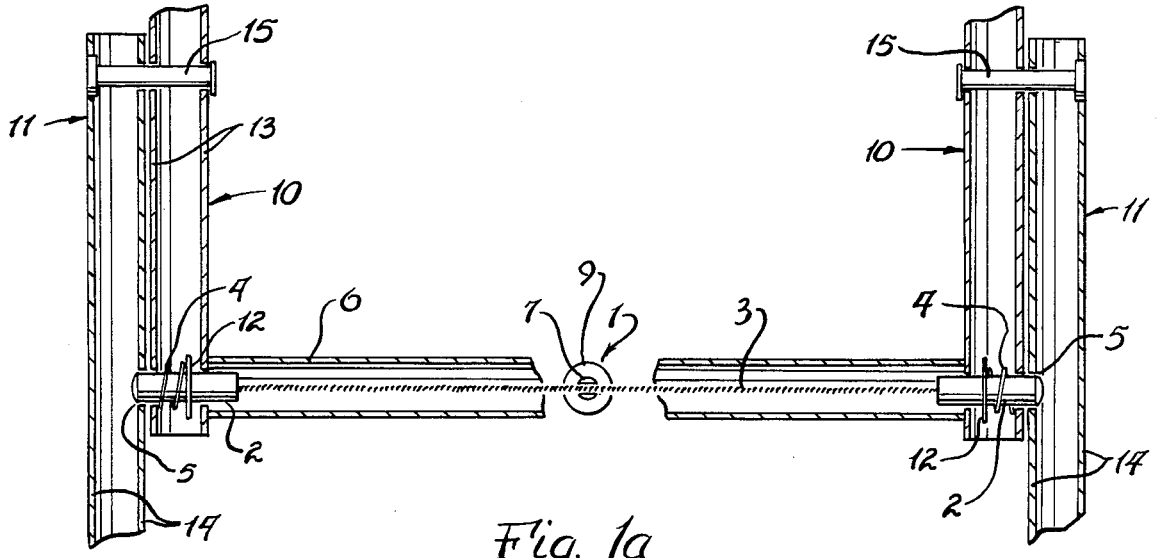
FIG. 1A illustrates in side elevation the module locking means of this invention having a centrally located lock release.
Figure 5A:
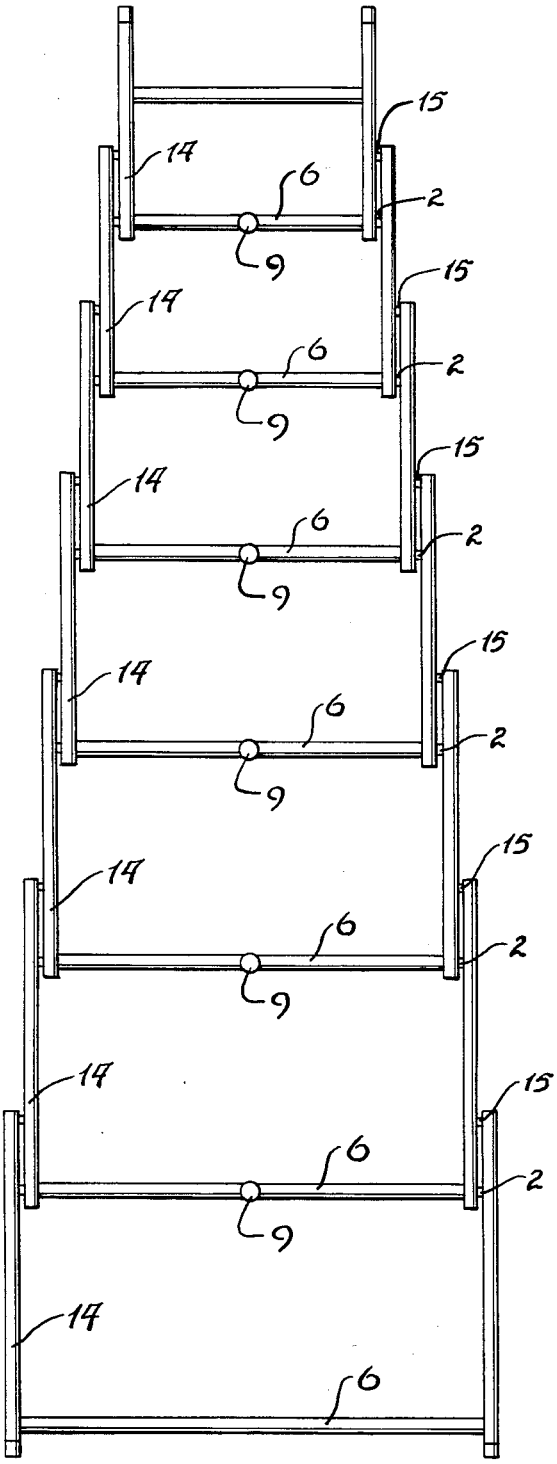
FIG. 5A illustrates an open ladder utilizing the module locking means of FIGS. 1A and 1B.

In FIG. 1A a module locking means is illustrated comprising an external lock release means 1, latches 2, a cord or wire 3 which connects latches 2, spring means 4 in contact with each latch 2, and a mating aperture 5 for each latch 2 used. Rung 6 has the forked stem 7 (in place of a "forked" stem a stem with an aperture through which the cord passes may be used), passing completely through its width (in one embodiment) and connected by a cotter pin or washer or ring 8 on the side of rung 6 opposite to finger turn piece 9. Forked stem 7 surrounds and encircles cord 3 so that when turn piece 9 and stem 7 are turned, latches 2 are pulled inwardly toward the center of rung 6 and are withdrawn from latch aperture 5. This withdrawal disengages module 10 from wider module 11 and permits the ladder to be folded down. Each latch 2 has a latch stop means 12 which stops or holds latch against the inner surface of side rail 13 and gives it the necessary leverage to spring the latch into and out of aperture 5 when lock release means 1 is turned. The aperture 5 is located in wider module side rails 14 and is positioned at about the same plane as latch 2 to permit the latch 2 to lock with the aperture 5 when the ladder is lifted into a vertical position (as shown in FIG. 5). After external lock release means or finger turn piece 1 is released when disengaged the latches will spring back so as to extend again beyond the outer surface of narrower side rails 13 as shown in FIG. 1. The outer surface of narrow module side rail 13 is adjacent to and parallel to the inner surface of side rail 14, thus latch 2 extending just beyond the outer surface of narrow module side rail 13 will automatically slide into aligned aperture 5 located in adjacent side rail 14. It is important to this invention that each U-shaped module have overlapping portions as shown in FIG. 5A and that these overlapping portions contain both the locking mechanisms and hinges 15.

Figure 1B:
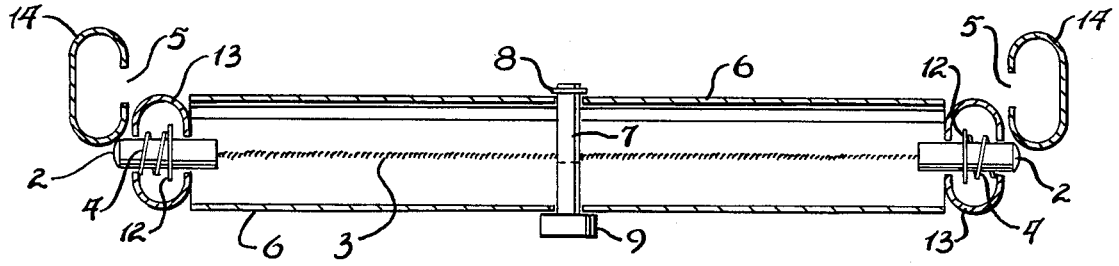
FIG. 1B illustrates in top perspective the module locking means of FIG. 1A having a centrally located lock release.

In FIG. 1B a top view of an embodiment of the locking mechanism of this invention is illustrated. Side rails 14 of wider module are shown preferably having an eliptical cross-sectional configuration so that latch 2 will easily slide into aperture 5. When finger turn piece 9 is rotated or turned, cord or wire 3 winds around the circumferential portion of stem 7 and draws latches 2 out of the apertures 5 and unlocks or disengages the ladder rung 15 from the wider module side rails 14. Lock release means 1 made up of finger piece 9 stem 7 and outer washer or ring 8 may extend through the entire width of rung 6 or may extend through only a portion of the width of rung 15. It is only important that the stem hook around cord or wire 3 to be operative. Thus, the stem 7 may be shorter than the distance between ring side walls of ring 6 if desired. Spring means 4 will permit latches 2 to snap into apertures 5 and lock therein unless finger piece 9 is again turned to release the latches as above described.

Figure 2:
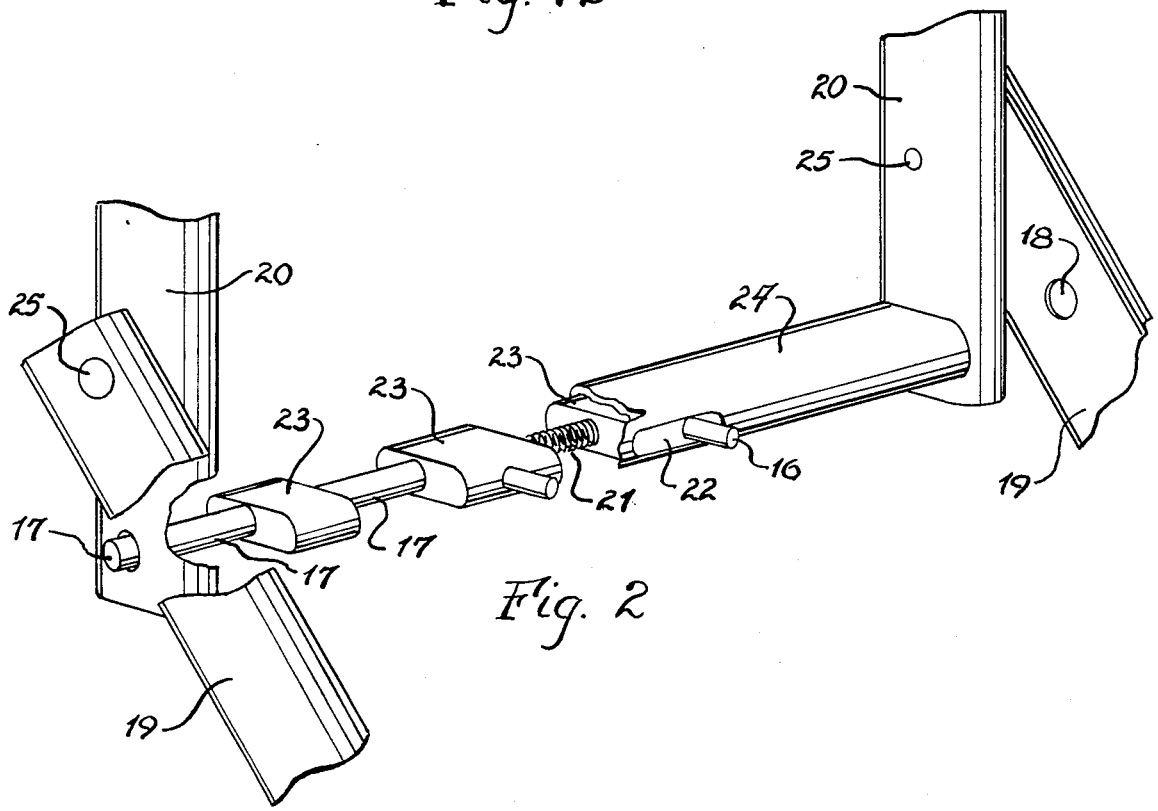
FIG. 2 illustrates in side perspective a module locking means having two pinch together type lock release means.

FIG. 2 shows a second embodiment of the locking mechanism of this invention. In this embodiment finger pieces or external latch release means 16 when pinched together with draw latches 17 from aperture 18 thus unlocks wider module rail 19 from narrower module side rail 20. If desired, aperture or conduit 18 can extend through the width of side rail 19, but the preferred structure is shown in the drawing. Spring means 21 permit the rod or latch 17 to move in and out of aperture 18 when external lock release means 16 are pinched together or otherwise moved toward each other. Lock release means 16 can be moved toward the center of the rung through slats 22 that are just long enough to conform to the length or amount of latch which penetrates aperture 18. Blocks 23 are used as guides within rung 24 to maintain rod or latch 17 in position so that it will easily mate with aperture 18. Any latch guide means may be used, however. Hinge 25 is shown above the locking mechanism and latch 17. However, it may be positioned below latch 17, if desired. It is only important in all embodiments of this invention that both the locking mechanism including latch 17, release means 16 and aperture 18 be in the overlapping portions of wider and narrow modules as clearly shown in FIG. 5A.

Figure 3A:
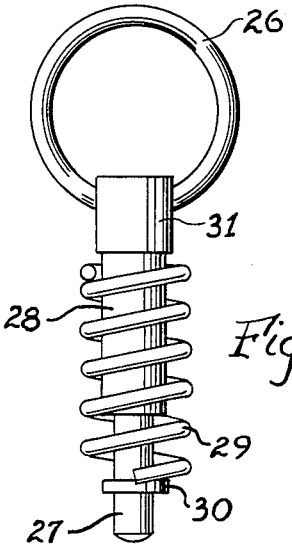
FIG. 3A illustrates in side elevation a single type lock mechanism that can be used in multiple locations in the ladder modules.
Figure 3B:
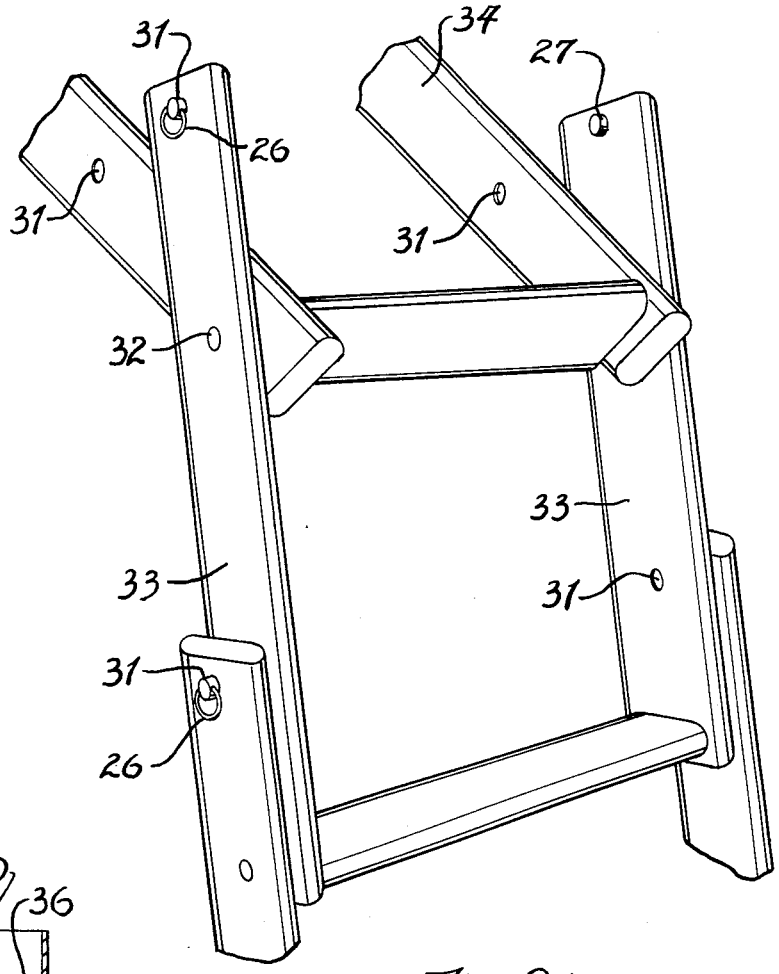
FIG. 3B illustrates a ladder section including the locking mechanism of FIG. 3A.

FIG. 3A shows a single latch locking mechanism useful in the ladder shown in FIG. 3B and similar ladders. This single latch mechanism includes a turn or pull finger piece 26 which is attached to a central rod 27. Rod 27 is positioned within outer cylinder 28 so that when finger piece 26 is pulled, rod 27 which is telescoped within cylinder 27 will release or unlock the adjacent ladder modules, and spring 29 will cause it to snap back when the pulling pressure ceases. Spring stop 30 provides the springing action required when ring 26 is pulled. Portion 31 and rod 27 are one integral piece. Rod 27 is in substantial alignment with mating aperture 31. The locking mechanism of FIG. 3A is shown above hinge 32 in the ladder of FIG. 3B but it can also be positioned below hinge means 32, if desired. Again, it is only important in all embodiments of this invention that both the hinge and locking mechanism be located in the overlapping module portions of the ladder, as shown in FIGS. 5A and 3B. In FIG. 3B wider module side rails 33 may contain either the locking latch means 26, 27, 28 and 29 or the aperture 31. Narrower side rails also may contain either the aperture 31 or the locking latch means 26, 27, 28 and 29.

Figure 4A:
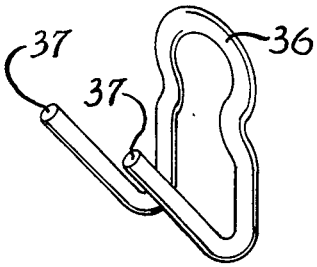
FIG. 4A illustrates both a novel resilient means and a ladder cutaway section illustrating said resilient means that can be used in lieu of a spring.
Figure 4A:
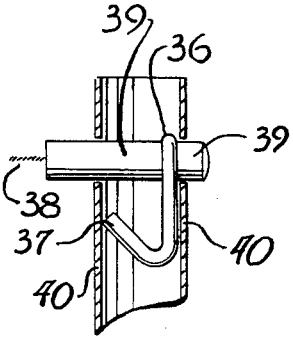

FIG. 4A shows a fork-shaped spring means 35 that may be used in all embodiments of this invention in lieu of conventional springs as shown in FIG. 3A at 29 or FIGS. 1A and 1B at 4. This spring means comprises a one piece metal having a loop 36 at one end and a forked structure 37 at the opposite end. When cord 38 is pulled latch 39 will spring in and out from side rail 40 in the same fashion as described in the above descriptions of the earlier figures. The module containing the mating aperture is not shown in this figure but it is clear from the earlier figures that latch 39 can be moved into and out of a mating latch by cord or wire 38 to lock the ladder modules in place.

Figure 4B:
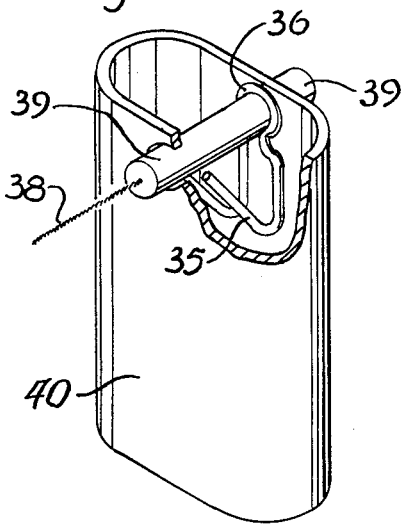
FIG. 4B illustrates resilient means that can be substituted for the resilient means of FIG. 4A.
Figure 4B:
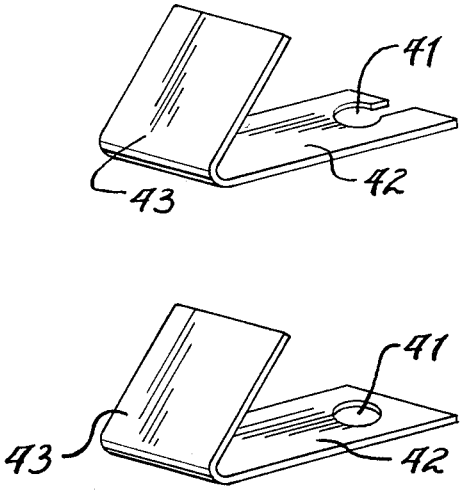

FIG. 4B discloses alternative spring means to the element 36 and 37 shown in FIG. 4A. Rather than a spring resilient wire portion (36 and 37), a solid spring metal piece made from one piece of suitable metal could be used. Aperture 41 is used to accommodate the latch 39 of FIG. 4A. The spring steel or metal piece 42 has a bend 43 which gives the resilient or spring action required. Suitable guides can be used in the interior of side rail or alternatively ring 40 to hold the spring means in place.

Figure 5B:
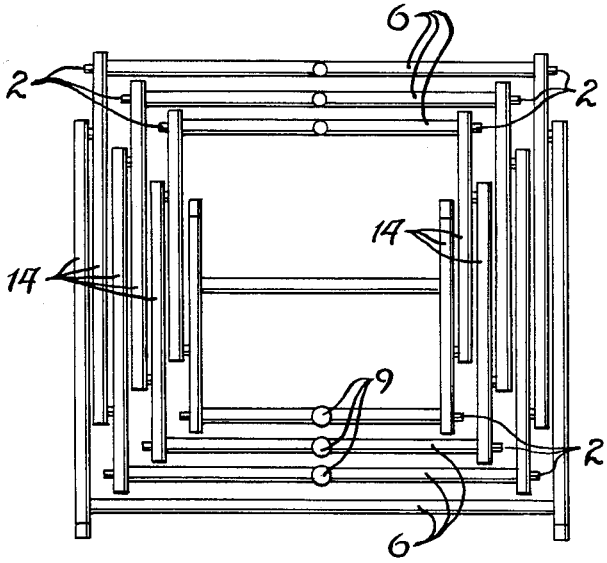
FIG. 5B illustrates a folded down ladder utilizing the module locking means of FIGS. 1A and 1B.

FIGS. 5A and 5B show the complete ladder including modules when set up for use (FIG. 5A) or folded down for storage or carrying (FIG. 5B). Wider side rails 14 are shown overlapping with the narrower side rails immediately above it. Hinges 15 and latches 2 (including entire locking mechanism) are both located within this overlapping portion. Thus, the upper part of the wider modules overlaps with the lower part of the narrower U-shaped modules. These modules are made up of rungs 6 and side rails 14. In the rungs 6 are locking mechanisms with external release means 9 or, in the alternative, will have the configuration of FIG. 3B. When folded down each narrow module will fold inside the next adjacent wider modules as shown in FIG. 5B and described in the parent applications above mentioned.

The preferred embodiments of the present invention have been described herein and shown in the accompanying drawings to illustrate the underlying principles of the invention, but it is to be understood that numerous modifications such as squared side rails or rungs rather than the preferred curved surface of modified eliptical cross-section of tubing may be used without departing from the broad spirit and scope of the invention.

What is claimed is

1. A U-shaped ladder module of a fold-up ladder wherein said ladder comprises a plurality of said Ushaped modules having diminishing upward size and connected to each other by hinges located in overlapping portions of said modules, said ladder modules comprising hinges and a locking mechanism, said locking mechanism comprising an external lock release means, latch means and aperture means said external lock release means adapted to be moved in such a way so as to position said latch means in either a locking or unlocking position in relation to said aperture means, said latch and said aperture each located in separate but adjacent modules of said ladder and adapted to mate when aligned and lock said modules in position, and wherein said locking mechanism located in each of said modules comprises two latches connected by a flexible connecting means, said latches in cooperation with a spring means and a lock release means, said release means adapted to be moved in such a way so as to move said latches away from said apertures.

2. The ladder module of claim 1 wherein said latch is spring loaded internally of said module and extends out at least partially therefrom, said external release means adapted to move said latch into and out of said aperture.

3. The ladder module of claim 1 wherein said hinge and said locking mechanism are both positioned within said overlapping portions, said hinge located above said locking mechanism.

4. The ladder module of claim 1 wherein said hinge and said locking mechanism are both positioned within said overlapping portions, said hinge located below said locking mechanism.

5. The ladder module of claim 1 wherein only one latch and one aperture are positioned therein.

6. The ladder module of claim 1 wherein two latches and two apertures are positioned therein.

7. The ladder module of claim 1 wherein said modules and said latches have curved and tapered surfaces respectively.

* * * * *